US007455078B2

(12) United States Patent
Swaine

(10) Patent No.: US 7,455,078 B2
(45) Date of Patent: Nov. 25, 2008

(54) NON-MARKING ENDLESS WOVEN PRESS FELT SEAM

(75) Inventor: Brent Swaine, Arnprior (CA)

(73) Assignee: AstenJohnson, Inc., Charleston, SC (US)

( * ) Notice: Subject to any disclaimer, the term of this patent is extended or adjusted under 35 U.S.C. 154(b) by 39 days.

(21) Appl. No.: 11/461,786

(22) Filed: Aug. 2, 2006

(65) Prior Publication Data

US 2007/0028995 A1 Feb. 8, 2007

(30) Foreign Application Priority Data

Aug. 2, 2005 (GB) ..... 0515928.0

(51) Int. Cl.

| | |
|---|---|
| ***D21F 1/12*** | (2006.01) |
| ***D21F 7/10*** | (2006.01) |
| *D03D 25/00* | (2006.01) |
| *D21F 1/10* | (2006.01) |

(52) U.S. Cl. ..... 139/383 AA; 139/383 A; 162/358.1; 162/900; 162/902; 162/904

(58) Field of Classification Search ..... 139/383 A, 139/383 AA; 162/358.1, 900, 902, 904
See application file for complete search history.

(56) References Cited

U.S. PATENT DOCUMENTS 4,006,760 A * 2/1977 Romanski et al. ..... 139/383 A
4,103,717 A * 8/1978 Clark ..... 139/383 A
4,123,022 A * 10/1978 Dutt et al. ..... 245/10
4,186,780 A * 2/1980 Josef et al. ..... 139/383 AA
4,418,726 A * 12/1983 Josef et al. ..... 139/383 AA
4,824,525 A * 4/1989 Penven ..... 162/358.2
4,863,786 A * 9/1989 Green et al. ..... 442/241
4,892,781 A * 1/1990 Penven ..... 442/189
4,896,702 A 1/1990 Crook
5,454,405 A * 10/1995 Hawes ..... 139/383 A
5,531,251 A 7/1996 Rydin
5,732,749 A 3/1998 Fargeout
5,904,187 A * 5/1999 Davenport ..... 139/383 AA
6,000,441 A 12/1999 Lee et al.
6,079,454 A 6/2000 Lee et al.

(Continued)

FOREIGN PATENT DOCUMENTS

EP 0182597 5/1986

(Continued)

*Primary Examiner*—Bobby H Muromoto, Jr.
(74) *Attorney, Agent, or Firm*—Volpe and Koenig, P.C.

(57) ABSTRACT

A method of making a seam for an endless woven multilayer papermakers fabric such as a press felt base fabric, comprises selecting a repeating weave pattern so as to provide during weaving a body portion woven as a double layer, and a shed change for the warp yarns adjacent to the warp yarns of the body portion to provide a first and second seaming portion. In each seaming portion the warp yarns are separated into an upper group and a lower group such that the weft yarn interweaves separately with each group to form a distinct upper and lower layer. A forming wire is provided at the vertically aligned lateral edges of the fabric, and the weft yarn in sequence interweaves with the upper group of warp yarns to provide the upper layer, forms a seaming loop about the forming wire and interweaves with the lower group of warp yarns to provide the lower layer. The method and a fabric made by the method provide improved uniformity of the seaming loops and reduced sheet marking in the seam area.

6 Claims, 4 Drawing Sheets

U.S. PATENT DOCUMENTS

| | | | | |
|---|---|---|---|---|
| 6,117,274 | A | 9/2000 | Yook | |
| 6,213,164 | B1 * | 4/2001 | Ostermayer et al. | 139/383 AA |
| H1974 | H * | 7/2001 | Lee et al. | 442/206 |
| 6,302,155 | B1 * | 10/2001 | Rydin | 139/383 AA |
| 6,450,213 | B1 * | 9/2002 | Gauthier et al. | 139/383 AA |
| 6,508,278 | B1 | 1/2003 | Kornett | |
| 6,773,553 | B2 * | 8/2004 | Hyvonen et al. | 162/358.2 |
| 6,776,878 | B2 * | 8/2004 | Yook | 162/358.2 |
| 7,093,621 | B2 * | 8/2006 | Canon et al. | 139/383 A |
| 7,141,144 | B2 * | 11/2006 | Rydin | 162/358.2 |
| RE39,709 | E * | 7/2007 | Fekete et al. | 162/358.2 |
| 2004/0168737 | A1 | 9/2004 | Zils | |
| 2004/0216798 | A1 * | 11/2004 | Aldrich | 139/383 A |
| 2005/0268980 | A1 | 12/2005 | Gardner et al. | |

FOREIGN PATENT DOCUMENTS

| | | |
|---|---|---|
| WO | 98/09706 | 3/1998 |

* cited by examiner

NON-MARKING ENDLESS WOVEN PRESS FELT SEAM

FIELD OF THE INVENTION

The invention concerns a method of making a low marking, easily joinable pin seam for use in an endless woven type papermakers fabric, particularly for a base fabric for a press felt. It also concerns base fabrics constructed so as to incorporate the seam, and press felts containing the base fabric and seam.

BACKGROUND OF THE INVENTION

The present invention relates to a novel seam which is intended for use in endless woven type papermakers fabrics, more particularly for base fabrics for press felts. The majority of press felts in use today include base fabrics which are formed either by spirally winding and joining relatively narrow strips of flat woven cloth so as to build up a desired fabric width, flat weaving the base fabric to the desired full width and length of the finished fabric, or by the so-called endless weaving process. Endless woven type base fabrics for press felts are well known in the papermaking industry and have been in widespread use for many years. Regardless of the type of base fabric construction that is employed, it is desirable in certain instances to be able to incorporate into the base fabric means for seaming the fabric to facilitate its installation on the papermaking machine for which it is intended. Approximately 40% of press fabrics manufactured at present contain a seam.

In the endless weaving process, the fabric is woven such that two layers are formed simultaneously, in a manner similar to a tubular garment such as a tube sock. During weaving, a continuous weft yarn is interwoven with the warp yarns somewhat like a spiral, but when the fabric is installed on the papermaking machine, the fabric is rotated such that the weft yarns are oriented in the machine direction (MD) of the fabric, and the warp yarns in the loom become oriented in the cross-machine direction (CD) of the fabric. The endless weaving process produces a fabric whose length is twice the width of the reed on the loom. Although this process uses a single continuous weft yarn, it is known and understood to refer to "weft yarns" as indicative of segments of the weft yarn and their paths in one of the fabric layers, and references herein to "weft yarns" should be understood as having this meaning.

When a seamed endless woven fabric is to be manufactured, the first layer of cloth is anchored at one side of the loom by its weft yarns to a so-called forming wire, so as to form seaming loops; at the opposite side of the loom, the fabric is folded over on itself and the weft yarns are brought back to the forming wire. The manner of weaving the continuous weft yarn across the body of the fabric, around the forming wire and back into the fabric results in a fabric having at least two layers of weft yarns in its construction. In this manner, an endless structure is produced which includes the seam already formed during the weaving process. These manufacturing techniques are well known to those of skill in the art and variants thereto have been described in the patent literature, for example in U.S. Pat. No. 4,896,702 to Crook, U.S. Pat. No. 5,531,251 to Rydin, and U.S. Pat. No. 5,732,749 to Fargeout. It is also known from U.S. Pat. No. 6,508,278 to Kornett, in a system requiring three sets of CD yarns, to modify one or more of the yarn denier, yarn spacing or weave pattern of the yarns in the fabric adjacent to the seam so as to improve the properties of the fabric in that area to be more consistent with the properties of the remainder of the fabric to reduce sheet marking.

However, a problem common to all of the prior art pin seam constructions has been the ability to attain acceptable uniformity of the seaming loops to facilitate installation on the papermaking machine, after the forming wire is removed, and subsequently replaced by a pintle to secure the seam for operation. Theoretically, the manufacturing process should produce uniform seaming loops with little variation in the orientation, size and shape, but this is seldom the case in actual fact. As a result, the seam loops are difficult to mesh together in order to provide a clear and open channel for the pintle.

Various constructions have been suggested, for example in U.S. Pat. No. 6,000,441 and U.S. Pat. No. 6,079,454, both to Lee et al., which have attempted to address the problem of producing more uniform seaming loops. However, none have been entirely successful to date.

SUMMARY

The present inventor has discovered that, if the weave pattern of the endless woven base fabric is modified proximate to the forming wire on the loom, such that the double layer construction of the fabric is opened up to provide a loop forming single layer weave construction, then it is possible to form the seaming loops in this single layer area and obtain the desired benefits of improved loop uniformity, reduced loop variation and a generally flatter, low-marking seam than has previously been possible in prior art constructions.

Thus, the present invention seeks to provide a method of making a novel seam for use in an endless woven papermakers fabric construction, a novel seam for an endless woven base fabric, a base fabric incorporating the novel seam, and a press felt including the base fabric and seam. The base fabric is woven according to a weave pattern which requires a multiple of 8 sheds to weave on the loom; thus, 8, 16, 24 etc. shed constructions would be suitable for the practice of the invention, where the weave design includes a set of warp yarns which are interwoven with a continuous weft yarn system which is arranged in two layers.

Adjacent the vertically aligned lateral edges of the fabric, where the seaming loops are to be formed around the forming wire, the weave pattern of the fabric is modified so that the warp yarns separate into upper and lower warp yarns in a seaming portion of the fabric. In the body portion of the fabric, the weft yarns are interwoven with selected ones of the warp yarns to form a continuous double layer structure; but in the seaming portion, the fabric separates into a first (upper) and second (lower) layer. In the upper layer, the weft yarn interweaves with only selected warp yarns which will comprise the upper warp yarns, and in the lower layer, the weft yarn interweaves with only selected warp yarns which will comprise the lower warp yarns. The seaming loops are formed by the weft yarn as it follows a path from the upper layer around the forming wire and continues into a path in the lower layer.

The substantially uniform seaming loops thus formed provide an open channel through which the pintle, which will eventually be used to join the fabric ends together, can be easily inserted.

The invention therefore seeks to provide a method of making a seam for an endless woven multilayer papermakers fabric wherein first and second lateral edges of the fabric are aligned vertically during weaving, the method comprising (i) selecting a repeating weave pattern including a continuous weft yarn and a plurality of warp yarns so as to provide during weaving (a) a body portion woven as a double layer;

(b) a shed change for the warp yarns adjacent to the warp yarns of the body portion to provide a first and second seaming portion, such that in each seaming portion the warp yarns are separated into a group of upper layer warp yarns and a group of lower layer warp yarns such that the weft yarn interweaves with each group consecutively to form a distinct upper and lower layer; and (ii) providing a forming wire at the vertically aligned lateral edges of the fabric whereby in each seaming portion, the weft yarn in sequence interweaves with the upper layer warp yarns to provide the upper layer, forms a seaming loop about the forming wire and interweaves with the lower layer warp yarns to provide the lower layer.

The invention further seeks to provide an endless woven multilayer papermakers fabric made according to the method of the invention. Preferably, the fabric is woven to a pattern requiring an integer multiple of 8 sheds in the loom.

The method and fabrics of the invention are particularly suitable for press felt base fabrics, which can be incorporated into press felts.

BRIEF DESCRIPTION OF THE DRAWINGS

The invention will now be described with reference to the drawings, in which.

DETAILED DESCRIPTION OF THE PREFERRED EMBODIMENTS

Figure 1:
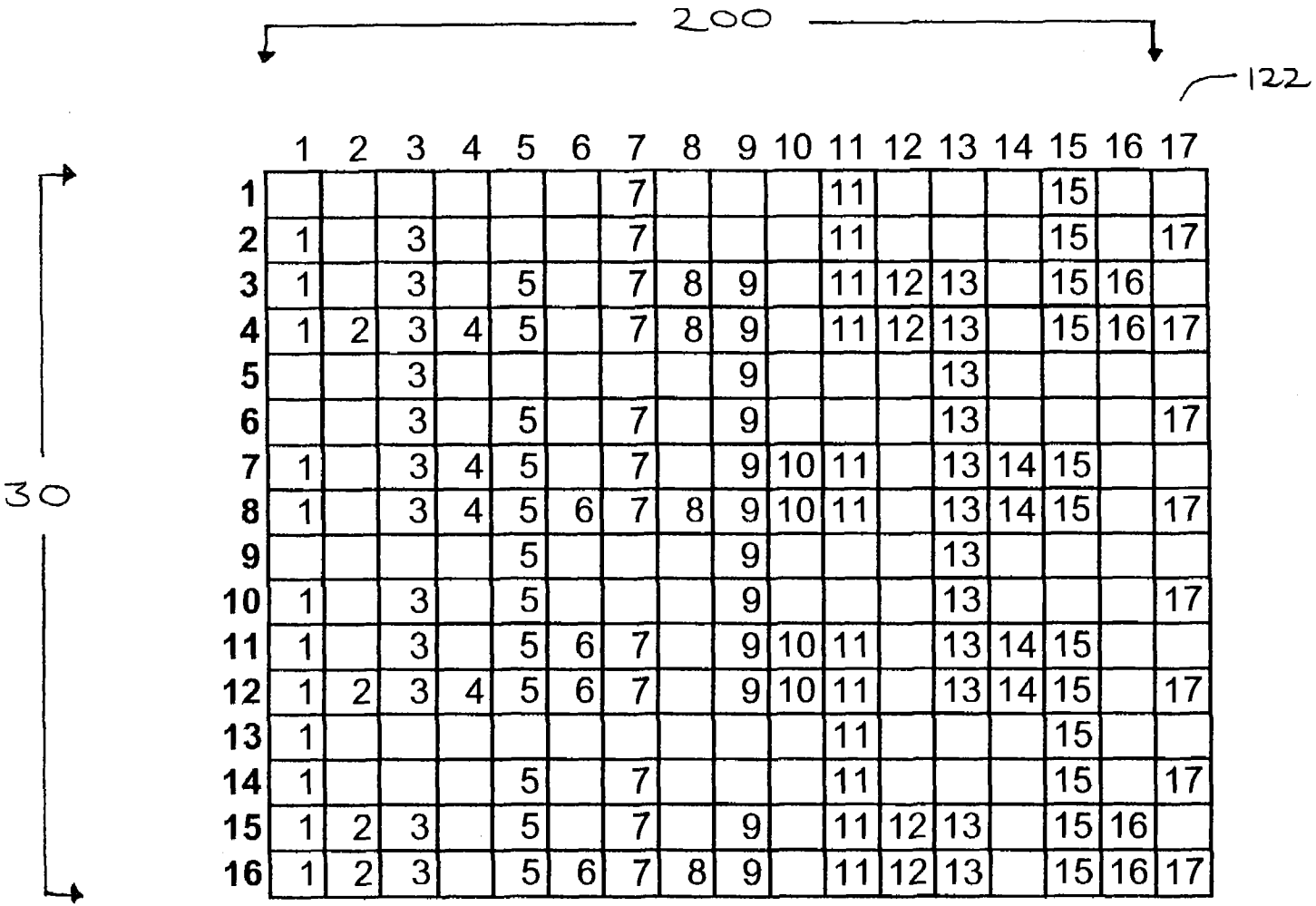
FIG. 1 is a weave diagram of an embodiment of the invention.
Figure 2:
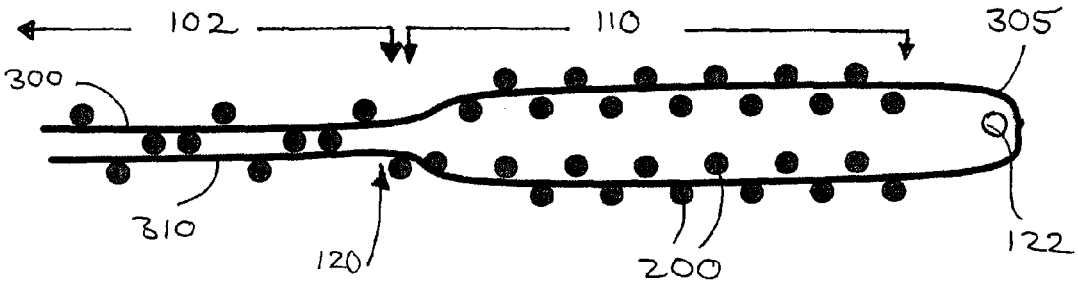
FIG. 2 shows the path of a weft yarn forming a seaming loop at a seaming portion of a fabric of the invention.

Referring first to FIGS. 1 and 2, an endless woven fabric 100 comprises a body portion 102, having a seaming portion 110 at each lateral edge. During weaving, the body portion 102 is folded over itself so that the two lateral edges of the fabric are aligned vertically. In the body portion 102, a continuous single weft yarn 30 interweaves with selected warp yarns 200, in a double layer weave pattern. However, by a shed change at the point 120, the warp yarns 200 are separated into two groups to form a seaming portion 110. In this portion, the weft yarn 30 follows a weft yarn path 300 to interweave only with the first group of warp yarns 200 to form an upper layer 112. The weft yarn 30 then passes around a forming wire 122 to form a seaming loop 305, and returns to interweave with the second group of warp yarns 200 in a weft yarn path 310 to form a lower layer 116, before continuing to interweave with the warp yarns 200 according to the repeating weave pattern for the body portion 102. At the seaming portion 110 adjacent the other edge of the body portion 102, a similar shed change and separation of the warp yarns 200 occurs, so that the weft yarn 30 follows a similar path, i.e. interweaving in weft yarn path 300 to form an upper layer 112, passing around the forming wire 122 to form a second seaming loop 305, and returning by weft yarn path 310 to form a lower layer 116, and thence to interweave with the warp yarns 200 in the body portion 102.

FIG. 1 is a weave diagram of an embodiment of the invention, showing the pattern for the seaming portion 110 and adjacent yarns of the body portion 102. The warp yarns 200 of the fabric 100 are indicated across the top of the diagram, and identified by the numbers 1 to 16, and the forming wire 122 is identified by the number 17. The steps in the path of continuous weft yarn 30 are identified by the numbers 1 to 16 vertically down the left side of the diagram.

Figure 3:
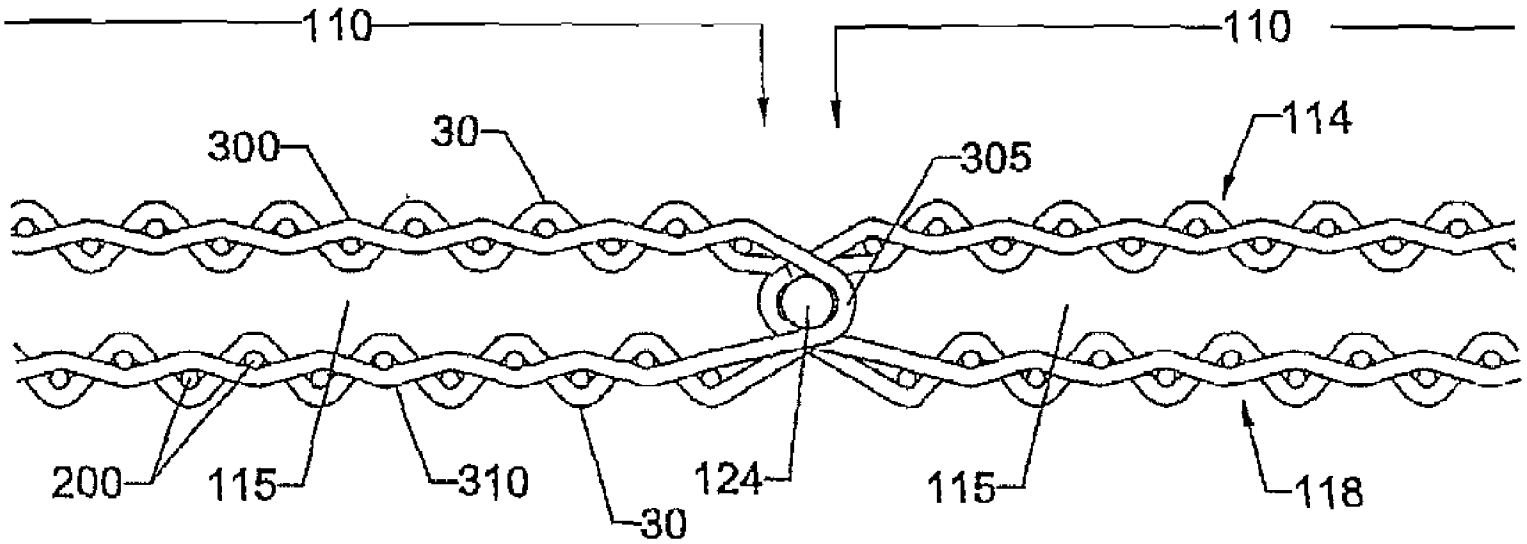
FIG. 3 is a photographic side view of the seam area of an embodiment of the invention.
Figure 4:
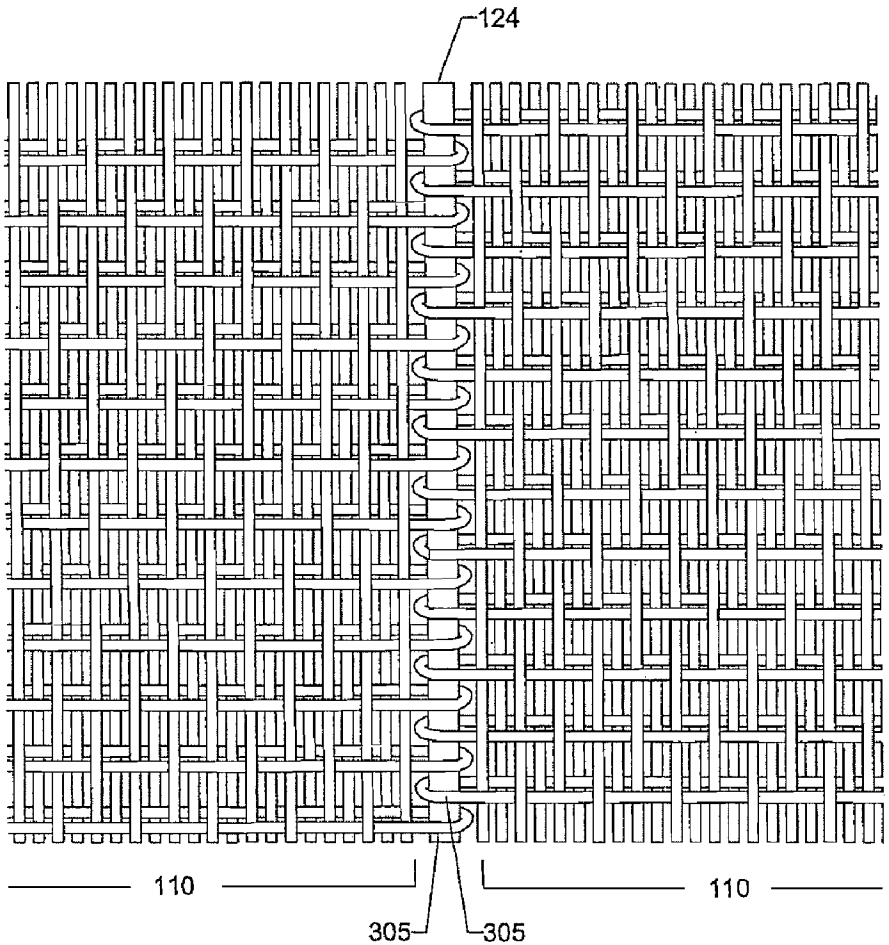
FIG. 4 is a photograph top view of the seam area of the embodiment of FIG. 3.

After the desired number of repeats of these steps, the woven fabric can be removed and finished in the usual manner, including the known process of needling with batt in the case of a press fabric, and replacement of the forming wire 122 by a pintle 124 (shown in FIGS. 3 and 4).

This figure illustrates one embodiment of the invention. The worker skilled in the art will recognize that other weave patterns are possible using a multiple of 8 sheds in the loom, depending on the intended end use of the fabric.

Referring to FIG. 3, a side view of a seam of the invention is shown. At the centre, a series of seaming loops 305, alternating from the left and right seaming portions 110, are retained by a pintle 124, and connect the distinct upper and lower layers 112 and 116 of the respective seaming portion 110. In the paper side surface 114, upper layer 112 on each side of the pintle 124 comprises the first group of warp yarns 200 interwoven with the weft yarn 30 in the weft yarn path 300. In the machine side surface 118, lower layer 116 on each side of the pintle 124 comprises the second group of warp yarns 200 interwoven with the weft yarn 30 in the weft yarn path 310. As can clearly be seen from this photograph, the upper and lower layers 112, 116 are completely distinct in the seaming portion 110, coming together at the point 120 (shown in FIG. 2) where the shed change integrates the two layers into the double layer body portion 102.

The separation of the upper and lower layers 112, 116, resulting in an internal channel 115, provides to the seaming loops 305 a degree of flexibility which allows them to move easily, thereby improving interdigitation of the seaming loops 305 and cushioning the seam region, thereby reducing seam marking on the paper sheet.

Further, referring also to FIG. 4, which is a top view of a seam of the invention, it can clearly be seen that the highly uniform seaming loops 305, formed around the pintle 124 alternately from the left and right seaming portions 110, provide a configuration substantially similar to the adjacent surfaces of the fabric. This advantageous feature further reduces or eliminates marking of the paper sheet.

Due to the improved uniformity of the loops formed by the method of the invention, pintle insertion is facilitated during installation in the papermaking machine for which the fabric is intended, in addition to the advantages discussed above in reduction of sheet marking when the fabric is in use.

The invention claimed is:

1. A method of making a pin seam in a multilayer papermakers fabric to be closed by a single pintle to form for an endless woven multilayer papermakers fabric, wherein the fabric comprises a fabric body having a first and second lateral edge, the method comprising selecting a repeating weave pattern including a continuous weft yarn, a plurality of warp yarns, a first forming wire at the first lateral edge and a second forming wire at the second lateral edge, weaving the fabric such that a body portion woven as a double layer to forms the fabric body;

making a shed change for the warp yarns adjacent to the warp yarns of the body portion to provide a first seaming portion at the first lateral edge and a second seaming portion at the second lateral edge, and in each seaming portion (A) separating the warp yarns into a group of upper layer warp yarns and a group of lower layer warp yarns; and (B) interweaving the continuous weft yarn with each group consecutively, in sequence interweaving with the upper layer warp yarns to provide an upper layer of the seaming portion, forming a seaming loop about the forming wire and interweaving with the lower layer warp yarns to provide a lower layer of the seaming portion.

2. A method of making a seam as claimed in claim 1, wherein the endless woven multilayer papermakers fabric is a press felt base fabric.

3. An endless woven multilayer papermakers fabric having a pin seam comprising seaming portions closeable by a single pintle the fabric comprising:

a fabric body having a first and second lateral edge, the fabric being formed with a selected repeating weave pattern including a continuous weft yarn, a plurality of warp yarns, a first forming wire at the first lateral edge and a second forming wire at the second lateral edge, so as to provide during weaving;

(a) a body portion woven as a double layer to form the fabric body;

(b) a shed change for the warp yarns adjacent to the warp yarns of the body portion to provide a first seaming portion at the first lateral edge and a second seaming portion at the second lateral edge, such that in each seaming portion (A) the warp yarns are separated into a group of upper layer warp yarns and a group of lower layer warp yarns; and (B) the continuous weft yarn interweaves with each group consecutively, in sequence interweaving with the upper layer warp yarns to provide an upper layer of the seaming portion, that forms a seaming loop about the forming wire and interweaves with the lower layer warp yarns to provide a lower layer of the seaming portion.

4. An endless woven multilayer papermakers fabric as claimed in claim 3, wherein the fabric is woven to a repeating weave pattern requiring an integer multiple of 8 sheds in the loom.

5. An endless woven multilayer papermakers fabric as claimed in claim 3, wherein the fabric is a press felt base fabric.

6. An endless woven multilayer papermakers fabric according to claim 3, wherein the papermakers fabric comprises a papermakers press felt.

* * * * *

UNITED STATES PATENT AND TRADEMARK OFFICE

CERTIFICATE OF CORRECTION

PATENT NO. : 7,455,078 B2
APPLICATION NO. : 11/461786
DATED : November 25, 2008
INVENTOR(S) : Brent Swaine It is certified that error appears in the above-identified patent and that said Letters Patent is hereby corrected as shown below:

In claim 1, at column 4, line 54, after the word “form”, delete “for”.
In claim 1, at column 4, line 62, after the word “layer”, delete “to”.

Signed and Sealed this

Sixteenth Day of June, 2009

JOHN DOLL
*Acting Director of the United States Patent and Trademark Office*